US006293126B1

(12) United States Patent
Higginbotham

(10) Patent No.: US 6,293,126 B1
(45) Date of Patent: Sep. 25, 2001

(54) AIR SEPARATION

(75) Inventor: Paul Higginbotham, Guildford (GB)

(73) Assignee: The BOC Group plc, Windelesham (GB)

( * ) Notice: Subject to any disclaimer, the term of this patent is extended or adjusted under 35 U.S.C. 154(b) by 0 days.

(21) Appl. No.: 09/690,403

(22) Filed: Oct. 17, 2000

(30) Foreign Application Priority Data

May 22, 1999 (GB) ..... 9925097

(51) Int. Cl.[7] ..... F25J 3/00
(52) U.S. Cl. ..... 62/646; 62/647
(58) Field of Search ..... 62/643, 646, 648, 62/653, 645, 647

(56) References Cited

U.S. PATENT DOCUMENTS 5,660,059 * 8/1997 Higginbotham ..... 62/646
5,887,447 * 3/1999 Higginbotham ..... 62/643
5,941,097 * 8/1999 Hogginbotham et al. ..... 62/646

* cited by examiner

*Primary Examiner*—William Doerrler
(74) *Attorney, Agent, or Firm*—Wan Yee Cheung; Salvatore P. Pace

(57) ABSTRACT

A double column air separation method in which a first stream of compressed air is cooled by passage through a main heat exchanger from its warm end countercurrently to a nitrogen stream withdrawn from the top of a lower pressure rectification column. The first stream of compressed air flows from the main heat exchanger into a higher pressure rectification column through an inlet. A second stream of compressed air is also passed into the warm end of the main heat exchanger and is cooled therein. The second stream of compressed air passes out of heat exchange with the nitrogen stream at a temperature lower than the exit temperature therefrom of the first stream of compressed air and at least 5K lower than the bubble point temperature of air at the pressure prevailing at the inlet. A stream of oxygen-enriched liquid passes isenthalpically from the bottom of the higher pressure column to the lower pressure column.

9 Claims, 1 Drawing Sheet

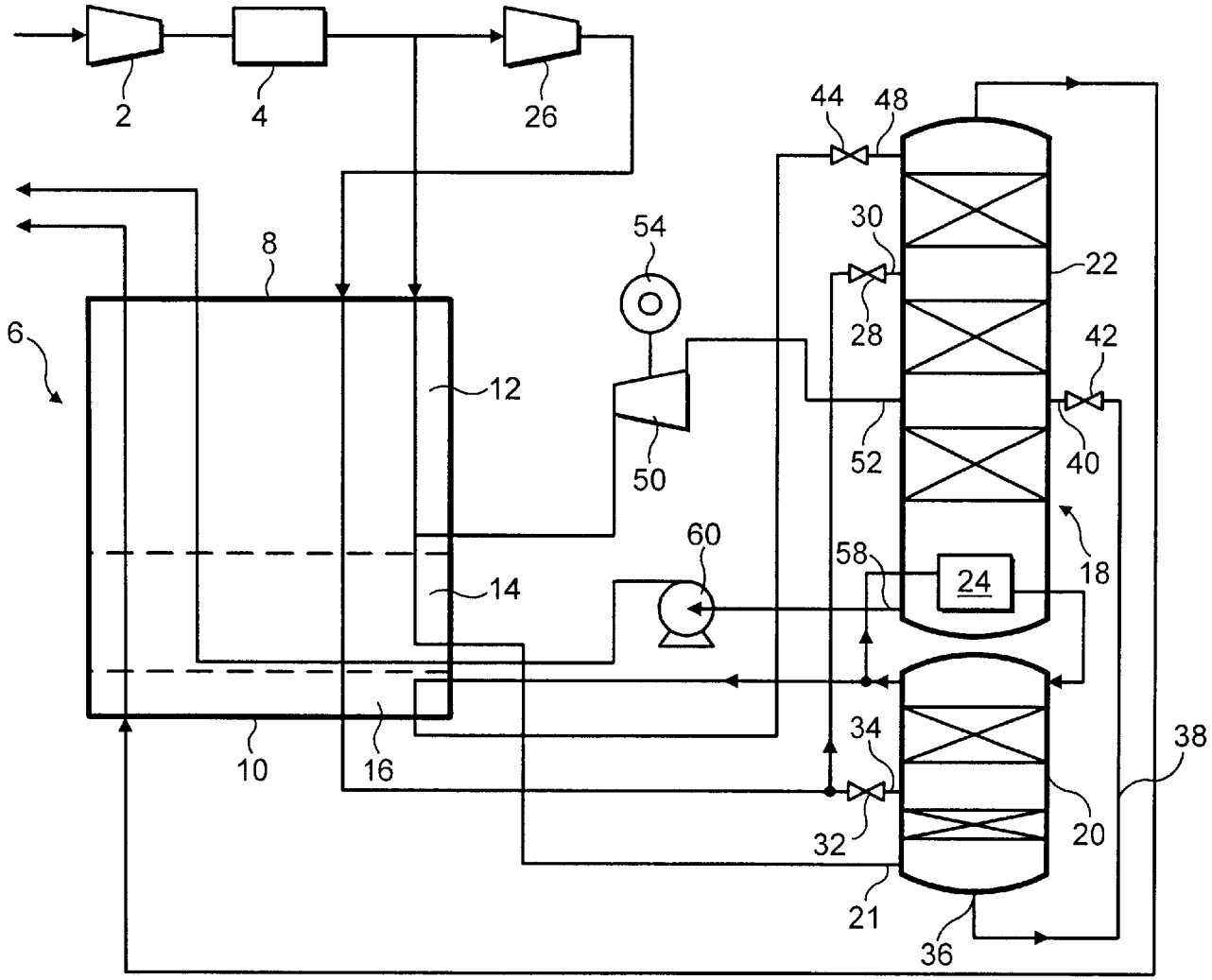
38
22
42
40
18
20
24
36
48
30
28
52
58
34
32
21
44
60
54
50
26
12
14
16
4
8
10
2
6

AIR SEPARATION

FIELD OF THE INVENTION

This invention relates to a method for separating air.

BACKGROUND OF THE INVENTION

The separation of air by rectification is very well known indeed. Rectification is a method in which mass exchange is effected between a descending stream of liquid and an ascending stream of vapour such that the ascending stream of vapour is enriched in a more volatile component (nitrogen) of the mixture to be separated and the descending stream of liquid is enriched in a less volatile component (oxygen) of the mixture to be separated.

In particular, it is known to separate air which has been cooled in a main heat exchanger in an arrangement of rectification columns comprising a higher pressure column and a lower pressure column. An initial separation is performed in the higher pressure column and as a result an oxygen-enriched liquid fraction is formed at its bottom and a nitrogen vapour fraction at its top. The nitrogen vapour fraction is condensed. A part of the condensate provides reflux for the higher pressure column and another part of the condensate provides reflux for the lower pressure column. A stream of oxygen-enriched liquid is withdrawn from the higher pressure column and is passed through an expansion device, normally a valve, into the lower pressure column. Here it is separated into oxygen and nitrogen fractions which may be pure or impure. Nitrogen and oxygen products are typically withdrawn from the lower pressure column and are returned through the main heat exchanger in countercurrent heat exchange with the first stream of compressed air. It is conventional to sub-cool the oxygen-enriched liquid stream upstream of the expansion device by indirect heat exchange with a nitrogen gaseous product stream withdrawn from the lower pressure column. Such sub-cooling reduces the amount of flash gas that is formed on expansion of the oxygen-enriched liquid stream. As a result, higher reflux ratios can be obtained in those regions of the lower pressure column below that at which the oxygen-enriched liquid stream is introduced, thereby facilitating the efficient operation of the lower pressure column. In addition, the sub-cooling has the effect of raising the temperature of the nitrogen product stream passing through the sub-cooler. This tends to have the benefit of reducing temperature differences in the main heat exchanger between air streams being cooled and product streams being warmed, and thereby leads to more efficient heat exchange. Nonetheless, the addition of a sub-cooler does add to the complexity of the air separation plant.

EP-A-0 848 220 shows, for example, in FIG. 8 an air separation plant in which the oxygen-enriched liquid stream taken from the higher pressure column is sub-cooled in the main heat exchanger. U.S. Pat. No. 5,275,004 discloses employing the main heat exchanger to perform the function of the reboiler-condenser that normally places the top of the higher pressure column in heat exchange relationship with the bottom of the lower pressure column. It is further disclosed in U.S. Pat. No. 5,275,004 that where the process comprises sub-cooling a liquid process stream in a sub-cooler, the sub-cooler's heat exchange service can be performed in the main heat exchanger.

It is an aim of the present invention to provide a method that enables a simplification of an air separation plant to be made without necessitating an undue loss of operating efficiency.

SUMMARY OF THE INVENTION

According to the present invention there is a method of separating air, wherein a first stream of compressed air is cooled in a heat exchanger and downstream of the cooling is rectified in an arrangement of rectification columns comprising a higher pressure column and a lower pressure column; a stream of oxygen-enriched liquid is withdrawn from the higher pressure column, is expanded and is introduced into the lower pressure column; a second stream of compressed air is cooled at a higher pressure than the first stream of compressed air; the first and second streams of compressed air are cooled in indirect countercurrent heat exchange with a gaseous nitrogen stream taken from the lower pressure column; the first stream of compressed air passes out of heat exchange relationship with the gaseous nitrogen stream at a higher temperature than the second stream; at least part of the second stream of air downstream of its heat exchange with the nitrogen stream is expanded and is introduced into the lower pressure column; and the stream of oxygen-enriched liquid passes essentially isenthalpically from the higher pressure column to its expansion, wherein the entire cooling of the second stream of compressed air from 0° C. is performed in the same heat exchanger as the cooling of the first stream of compressed air, and the second stream of air passes out of heat exchange with the nitrogen stream at a temperature at least 5 K lower than the bubble point temperature of air at the pressure prevailing at the inlet for the first stream of compressed air to the higher pressure column.

Because the stream of oxygen-enriched liquid passes isenthalpically of the first expansion device, it does not pass through a sub-cooler. The omission of a sub-cooler for the oxygen-enriched liquid stream facilitates the fabrication of the air separation plant because the conduit that conducts the oxygen-enriched liquid from the higher pressure column to the lower pressure column can be located relatively close to the columns and does not have to pass through a conventional sub-cooler separate from the main heat exchanger, or through the main heat exchanger itself in the manner of the corresponding conduit shown in FIG. 8 of EP-A-0 848 220. Further, the disadvantageous effect on the operation of the lower pressure column by not sub-cooling the stream of oxygen-enriched liquid is largely mitigated by the cooling of the second stream of compressed air to a lower temperature than the first stream of air. Preferably, the second stream of air passes out of heat exchange with the nitrogen stream at a temperature at least 5 K and more preferably at least 10 K less than the bubble point temperature of air at the pressure of the inlet to the higher pressure column. If supplied at a pressure less than its critical pressure, the second stream of compressed air is liquefied and sub-cooled in its indirect heat exchange with the nitrogen stream. Moreover, since many air separation processes make use of liquid air, little additional cost will typically be added by the sub-cooling of this air. Indeed, the entire cooling of the second stream of compressed air from 0° C. is preferably effected in the same heat exchanger as that in which the first stream of compressed air is cooled.

The first and second streams of compressed air are preferably also cooled by indirect heat exchange with a stream of oxygen withdrawn from the lower pressure column. The purity of the oxygen may be selected in accordance with the requirements of any process to which the oxygen is supplied.

Particularly efficient heat exchange can be achieved if the stream of oxygen is withdrawn in liquid state from the lower pressure column and is raised in pressure upstream of its heat exchange with the first and second streams of compressed air.

Typically the arrangement of rectification columns comprises a double rectification column in which an upper region of the higher pressure column is placed in heat exchange relationship with a lower region of the lower pressure column by a reboiler-condenser. In such examples of the method and plant according to the invention that employ a double rectification column a stream of liquid nitrogen is preferably withdrawn from the reboiler-condenser is sub-cooled, is expanded through a third expansion device, and is introduced into the lower pressure column as reflux. This additional sub-cooling is preferably performed in indirect heat exchange with the said gaseous nitrogen stream. Thus, the need to have a separate sub-cooler for the liquid nitrogen is obviated. Preferably, the gaseous nitrogen stream passes essentially isenthalpically from the lower pressure column into a main heat exchanger in which its indirect countercurrent heat exchange with the first and second streams of compressed air is performed. Alternatively, some heat exchange may take place in a separate heat exchanger between the gaseous nitrogen stream and the liquid nitrogen stream upstream of the gaseous nitrogen stream entering the main heat exchanger.

Preferably, not all of the cooled second stream of compressed air is introduced into the lower pressure rectification column. Some may be introduced into the higher pressure rectification column so as to enhance the liquid-vapour ratio in a lower region of that column. Typically, the heat exchange means therefore also communicates via a fourth expansion device with the higher pressure column. Preferably, each of the expansion devices is an expansion valve. Alternatively, one or more of the expansion devices, particularly the second expansion device, may be a turbo-expander. In another alternative arrangement, the second expansion device may comprise an arrangement of a turbo-expander and an expansion valve located downstream of the turbo-expander, the turbo-expander also giving as the fourth expansion device.

In one convenient arrangement, the entire flow of feed air is compressed in a main compressor, the resulting compressed feed air is purified by adsorption, and the first stream of compressed air is taken from the purified feed air, the remainder of the purified feed air being further compressed in a booster-compressor so as to form the second compressed air stream.

Refrigeration for the air separation method and plant according to the invention may be provided by any convenient method. If desired, for example, a third stream of compressed air may be taken at a suitable temperature from either the first or the second stream of compressed air and expanded with the performance of external work, typically in a turbo-expander, and introduced into one of the rectification columns, typically the lower pressure column. If liquid products are collected, a second turbo-expander may be used to provide additional refrigeration.

BRIEF DESCRIPTION OF THE DRAWING

The method according to the invention will now be described by way of example with reference to the accompanying drawing which is a schematic flow diagram of an air separation plant according to the invention.

The drawing is not to scale.

DETAILED DESCRIPTION OF THE INVENTION

Referring to FIG. 1 of the drawing, a flow of air is compressed in a main air compressor 2. Heat of compression is extracted from the resulting compressed air in an after-cooler (not shown) associated with the main air compressor 2. The compressed air flow is purified in an adsorption unit 4. The purification comprises removal from the air of relatively high boiling point impurities, particularly water vapour and carbon dioxide, which would otherwise freeze in low temperature parts of the plant. Other impurities such as unsaturated hydrocarbons are also typically removed. The unit 4 may effect the purification by pressure swing adsorption or temperature swing adsorption. The unit 4 may additionally include one or more layers of catalyst of the oxidation of carbon monoxide and hydrogen impurities to carbon dioxide and water, respectively. The oxidised impurities may be removed by adsorption. Such removal of carbon monoxide and hydrogen impurities is described in EP-A-438 282. The construction and operation of adsorptive purification units are well known and need not be described further herein.

A first stream of compressed, purified air flows from the purification unit 4 to a main heat exchanger 6 having a warm end 8 and a cold end 10. Apart from a reboiler-condenser 24, whose operation is described below, the main heat exchanger 6 is the only heat exchanger in the illustrated plant. The first stream of compressed air enters the main heat exchanger 6 at its warm end 8 and flows most of the way through the heat exchanger 6, and is withdrawn therefrom upstream of its cold end 10 but at a temperature suitable for its separation by rectification. The main heat exchanger 6 can be deemed to have three contiguous regions. These are a first region 12 extending from the warm end 8 of the main heat exchanger 6, which is a region in which only sensible heat is exchanged between gaseous streams. The end of the first region 12 occurs at a point in the main heat exchanger 6 where an air stream being cooled starts to change phase from vapour to liquid and/or a return stream being warmed completes a change from liquid to vapour state. From this point to a point nearer the cold end 10 of the main heat exchanger 6 there extends a second region 14 which is one where a second stream of compressed air being cooled, is liquefied by indirect heat exchange with a vaporising liquid stream. The third region 16, which terminates in the cold end 10 of the main heat exchanger 6, is a sub-cooling region.

The first stream of compressed air is withdrawn in vapour state from the first region 12 of the main heat exchanger 6 at a temperature suitable for its separation by rectification. The main heat exchanger 6 may be of the plate-fin kind and may comprise a single heat exchanger block or a plurality of heat exchanger blocks. The first air stream flows essentially isenthalpically and isobarically to a higher pressure column 20 and is introduced into the bottom thereof through an inlet 21. The higher pressure column 20 forms part of a double rectification column 18 including a lower pressure column 22 in addition to the higher pressure column 20. The top of the higher pressure column 20 is placed in heat exchange relationship with the lower pressure column 22 by the reboiler-condenser 24.

The remainder of the compressed, purified air, i.e. that part of the air leaving the purification unit 4 that is not taken as the first stream of compressed air, is further compressed in a booster-compressor 26 so as to form the second stream of compressed air at a pressure higher than that of the first stream. The second stream of compressed air is cooled in an after-cooler (not shown) associated with the booster-compressor 26 so as to remove heat of compression from the air. The second stream of air is thus cooled to a temperature a little above ambient temperature. The thus cooled second stream of compressed air flows through the main heat exchanger 6 from its warm end 8 to near its cold end 10. Accordingly, the cooling of the second stream of compressed air from its inlet temperature to 0° C. and from 0° C. to its exit temperature at the cold end 10 is effected in the same heat exchanger as the cooling of the first stream of compressed air. The second stream of compressed air is condensed in the second (liquefaction) region 14 and downstream thereof is sub-cooled, that is cooled to below its saturation temperature, in the third (sub-cooling) region 16 of the main heat exchanger 6. The second stream of the compressed air leaves the main heat exchanger 6 a little way before its cold end at a temperature lower by at least 10 K than the bubble point temperature of air at the pressure at which the first stream of compressed air enters the higher pressure column 20. Typically, the main heat exchanger 6 is operated such that there is at its cold end 10 an average temperature difference of no more than about 3 K between streams being warmed and streams being cooled.

One part of the sub-cooled second air stream is expanded through an expansion valve 28 and is introduced into an intermediate mass exchange region of the lower pressure column 22 through an inlet 30. The remainder of the sub-cooled second air stream is expanded through another expansion valve 32 and is introduced into an intermediate mass exchange region of the higher pressure column 20 through an inlet 34. Typically, about two-thirds of the sub-cooled second air stream flows to the lower pressure column 22.

Air is separated in the higher pressure column 20 into a nitrogen vapour phase that collects at its top and an oxygen-enriched liquid phase that collects at its bottom. A stream of the oxygen-enriched liquid is withdrawn from the bottom of the higher pressure column 20 through an outlet 36.

A conduit 38 for the flow of the stream of the oxygen-enriched liquid extends from the outlet 36 of the higher pressure column 20 to an inlet 40 to an intermediate region of the lower pressure column 22. Typically, the region of the column 22 served by the inlet 40 is below that served by the inlet 30. An expansion valve 42 is located in the conduit 38. The liquid is not subjected to any heat exchange in the conduit 38 upstream of the expansion valve 42 (or downstream of this valve) and thus flows to the valve 42 essentially isenthalpically. The oxygen-enriched liquid flashes through the valve 42 and a mixture of residual liquid and flash gas enters the lower pressure column 22 through the inlet 40.

A stream of the nitrogen vapour fraction separated in the higher pressure column 20 is withdrawn therefrom and is condensed in the reboiler-condenser 24 by indirect heat exchange with boiling oxygen. A part of the resulting condensate (liquid nitrogen) is returned to the top of the higher pressure column 20 and provides reflux for the separation of the air therein. The remainder of the liquid nitrogen condensate flows from the reboiler-condenser 24 to the sub-cooling region 16 of the main heat exchanger 6 and passes towards the cold end 10 of the main heat exchanger 6 and is thereby sub-cooled. The resulting sub-cooled liquid nitrogen stream leaves the main heat exchanger at or upstream of its cold end; flows through another expansion valve 44; is introduced into the top of the lower pressure column 22 through an inlet 48, and provides reflux for the lower pressure column 22.

The air streams introduced into the lower pressure column 22 through the inlets 40 and 30 are not the only air streams that are separated therein. A third stream of compressed air is withdrawn from the first stream of compressed air as it passes through the first region 12 of the main heat exchanger 6 and is expanded with the performance of external work in a turbo-expander 50 and is introduced into the lower pressure column 22 through an inlet 52 which is located at essentially the same level as the inlet 40. The external work performed by the turbo-expander 50 may, for example, be the operation of an electrical generator 54.

The various air streams introduced into the lower pressure column 22 are separated therein by rectification into a top nitrogen vapour fraction at the bottom liquid oxygen fraction. The liquid oxygen fraction may contain more than 99 mole per cent of oxygen, but, alternatively, may be impure, typically having an oxygen concentration in the range of 80 to 97 mole per cent. A stream of nitrogen vapour is withdrawn from an outlet 56 at the top of the lower pressure column 22 and flows essentially isenthalpically directly to the cold end 10 of the main heat exchanger 6. It flows through the sub-cooling region 16 of the main heat exchanger 6 countercurrently to the second stream of compressed air, thereby effecting the sub-cooling of this stream and also of the liquid nitrogen stream which is supplied as reflux to the top of the lower pressure column 22. The gaseous nitrogen stream flows from the sub-cooling region 16 of the main heat exchanger 6 to its liquefying region 14 and then its sensible cooling region 12 upstream of exiting the main heat exchanger 6 through its warm end 8 at approximately ambient temperature. A liquid oxygen product stream is withdrawn by means of a pump 60 through an outlet 58 at the bottom of the lower pressure column 22. The pump 60 raises the pressure of the liquid oxygen stream to a chosen pressure and sends it into the main heat exchanger 6, entering directly its liquefaction region 14. The pressurised liquid oxygen passes through this region countercurrently to the first and second streams of compressed air. The pressurised liquid oxygen stream is vaporised in this region by indirect countercurrent heat exchange with, in particular, the liquefying second stream of air. The resulting vaporised oxygen stream is warmed by passage through the sensible heat region 12 of the main heat exchanger 6 and leaves the warm end 8 at approximately ambient temperature.

The pressure of the second stream of compressed air may be selected in accordance with the pressure of the oxygen product stream so as to keep down the temperature difference between streams being warmed and streams being cooled in the main heat exchanger 6. The distribution of the sub-cooled stream of liquid air between the higher and the lower pressure columns may be determined so as to achieve the most favourable rectification conditions in these two columns. The introduction of liquid air into the lower pressure column 22 through the inlet 30 compensates for the loss of liquid reflux when the oxygen-enriched liquid stream is flashed through the valve 42. Notwithstanding the simplicity of the plant shown in FIG. 1, it is therefore capable of being operated reasonably efficiently. In a typical example, the operating pressure of the higher pressure column at its bottom is 5.4 bar; the operating pressure of the lower pressure column 22 at its top is 1.4 bar; the outlet pressure of the booster compressor 26 is 15.4 bar, and the outlet pressure of the liquid oxygen pump 60 is 6.5 bar.

Various changes and modifications may be made to the plant shown in the drawing. For example, the main heat exchanger 6 may comprise three separate heat exchangers corresponding with the regions 12, 14 and 16. Further, instead of using a double rectification column 18 with a single reboiler-condenser 24, a dual reboiler arrangement can be used instead. Moreover, particularly if the lower pressure column is used to produce an oxygen product containing more than 99 mole per cent of oxygen, an argon product can be additionally produced using a conventional argon "side-arm" column (not shown). In this instance, some or all of the expanded stream of oxygen-enriched liquid instead of passing directly to the lower pressure column 22 may instead be first used to cool a head condenser associated with the side-arm column. Furthermore, it is not essential that the oxygen product be withdrawn from the lower pressure column 22 in liquid state. If desired, it may be taken in vapour state. Another option is to produce some of the oxygen and/or nitrogen product as liquid. This option typically requires a greater production of liquid air than when vapour products are produced, and may be readily accommodated by the method according to the invention.

The second stream of compressed air may, if desired, be provided at a supercritical pressure. When so provided, the second stream of compressed air remains a supercritical fluid throughout its passage through the main heat exchanger 6 and is not liquefied as such. Nonetheless, providing the second stream of compressed air at a supercritical pressure does not detract from the essential advantages of the method and plant according to the invention.

I claim:

1. A method of separating air, wherein a first stream of compressed air is cooled in a heat exchanger and downstream of the cooling is rectified in an arrangement of rectification columns comprising a higher pressure column and a lower pressure column; a stream of oxygen-enriched liquid is withdrawn from the higher pressure column, is expanded and is introduced into the lower pressure column; a second stream of compressed air is cooled at a higher pressure than the first stream of compressed air; the first and second streams of compressed air are cooled in indirect countercurrent heat exchange with a gaseous nitrogen stream taken from the lower pressure column; the first stream of compressed air passes out of heat exchange relationship with the gaseous nitrogen stream at a higher temperature than the second stream; at least part of the second stream of air downstream of its heat exchange with the nitrogen stream is expanded and is introduced into the lower pressure column; and the stream of oxygen-enriched liquid passes essentially isenthalpically from the higher pressure column to its expansion, wherein the entire cooling of the second stream of compressed air from 0° C. is performed in the same heat exchanger as the cooling of the first stream of compressed air, and the second stream of air passes out of heat exchange with the nitrogen stream at a temperature at least 5K lower than the bubble point temperature of air at the pressure prevailing at the inlet for the first stream of compressed air to the higher pressure column.

2. The method claimed in claim 1, in which the second stream of air passes out of heat exchange with the nitrogen stream at a temperature at least 10K lower than the bubble point temperature of air at the pressure prevailing at the inlet for the first stream of compressed air to the higher pressure column.

3. The method claimed in claim 1, in which the first streams of compressed air are also cooled by indirect heat exchange with a stream of oxygen withdrawn from the lower pressure column.

4. The method claimed in claim 3, wherein the stream of oxygen is withdrawn in liquid state from the lower pressure column and is raised in pressure upstream of its heat exchange with the first and second streams of compressed air.

5. The method claimed in claim 1, wherein the arrangement of rectification columns comprises a double rectification column in which an upper region of the said higher pressure column is placed in heat exchange relationship with a lower region of the said lower pressure column by a reboiler-condenser.

6. The method claimed in claim 5, in which a stream of liquid nitrogen is withdrawn from the condenser-reboiler, is sub-cooled in indirect heat exchange with the said gaseous nitrogen stream, is expanded, and is introduced into the lower pressure column as reflux.

7. The method claimed in claim 1, in which the gaseous nitrogen stream passes essentially isenthalpically from the lower pressure column into a main heat exchanger in which the indirect countercurrent heat exchange of it with the first and second streams of compressed air is performed.

8. The method claimed in claim 1, wherein the sub-cooled second stream of compressed air is divided into two subsidiary streams, one subsidiary stream being expanded and introduced into the lower pressure column, and the other subsidiary stream being expanded and introduced into the higher pressure column.

9. The method claimed in claim 1, in which a third stream of compressed air is taken from the first or second stream of compressed air, is expanded with the performance of external work, and is introduced into the lower pressure rectification column.

* * * * *